US006865922B1

(12) United States Patent
Becker

(10) Patent No.: US 6,865,922 B1
(45) Date of Patent: Mar. 15, 2005

(54) VINYL SIDING LOCKING TOOL

(76) Inventor: Douglas P. Becker, 7602 Pacific St., Davenport, IA (US) 52806

( * ) Notice: Subject to any disclaimer, the term of this patent is extended or adjusted under 35 U.S.C. 154(b) by 0 days.

(21) Appl. No.: 10/457,987

(22) Filed: Jun. 9, 2003

Related U.S. Application Data

(60) Provisional application No. 60/401,867, filed on Aug. 8, 2002.

(51) Int. Cl.[7] ..... B21D 17/02

(52) U.S. Cl. ..... 72/409.18; 72/409.01; 425/318

(58) Field of Search ..... 72/409.01, 409.18, 72/409.19, 473, 414, 413; 425/458, 318, 12; 29/270, 268; 81/421, 422

(56) References Cited

U.S. PATENT DOCUMENTS 263,110 A * 8/1882 Beuttner ..... 72/409.01
2,837,948 A * 6/1958 Erdmann ..... 29/268
3,028,628 A * 4/1962 Rutherford ..... 425/193
3,624,876 A * 12/1971 Irvin ..... 29/267
3,774,425 A 11/1973 Veneziano
4,531,397 A * 7/1985 Pratt ..... 72/451
4,739,918 A * 4/1988 Stokes et al. ..... 228/173.6
6,050,041 A 4/2000 Mowery et al.
6,115,922 A 9/2000 Kline
6,240,764 B1 6/2001 Geurts
6,269,674 B1 * 8/2001 Sperko ..... 72/409.19

* cited by examiner

*Primary Examiner*—Daniel C. Crane
(74) *Attorney, Agent, or Firm*—Sturm & Fix LLP

(57) ABSTRACT

A hand tool is provided for securing adjacent vinyl siding strips. First and second handles, bearing first and second jaws, are pivotally attached. A first jaw forms a channel, and the second jaw supports a crimp bolt. A portion of one siding strip is disposed between the jaws. Actuation of the jaws moving the crimp bolt against the vinyl strip pushes the strip into the channel forming crimps on the strip, which crimps facilitate formation of a positive lock with an adjacent strip.

4 Claims, 4 Drawing Sheets

VINYL SIDING LOCKING TOOL

CROSS-REFERENCE TO RELATED APPLICATIONS

This application is a continuation of co-pending commonly owned U.S. Provisional Application No. 60/401,867, filed Aug. 8, 2002, entitled Vinyl Siding Locking Tool. Priority is claimed under 35 U.S.C. §119(e). The contents of the same are expressly incorporated herein by reference.

STATEMENT REGARDING FEDERALLY SPONSORED RESEARCH OR DEVELOPMENT

Not Applicable

AUTHORIZATION PURSUANT TO 37 C.F.R. § 1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates generally to the field of application of siding, particularly vinyl siding, to buildings, and more particularly to tools employed to secure one row of siding to an adjacent row of siding.

2. Description of the Related Art

Tools are available to crimp vinyl siding. Presently tools crimp the top of the piece of siding against an inside piece of utility trim. A positive lock is not always attained. This is a particular problem regarding achieving a secure connection between the top horizontal row of vinyl siding and the row immediately below, which row is typically the highest nailed piece of siding. A poor lock to the utility trim results in the top piece of siding loosening and falling away from the top nailed horizontal row of vinyl siding.

Tin snips have been employed with a twisting motion in an attempt to provide a more secure attachment however, the technique is difficult to teach to workers. Therefore, there exists a need for method and apparatus for more efficiently securing adjacent pieces of vinyl siding in general, and the top piece of siding to the top nailed piece of siding in particular.

BRIEF SUMMARY OF THE INVENTION

The present invention discloses a hand tool for locking together adjacent vinyl siding strips. First and second handles, bearing first and second jaws, are pivotally attached. A first jaw forms a channel, and the second jaw supports a crimp bolt. A portion of a siding strip is disposed between the jaws. Actuation of the jaws moving the crimp bolt against the vinyl strip pushes the strip into the channel forming crimps, which crimps facilite formation of a positive lock with an adjacent strip.

Other objects, advantages, and novel features of the present invention will become apparent from the following detailed description of the invention when considered in conjunction with the accompanying drawings.

DETAILED DESCRIPTION OF THE INVENTION

Figure 1:
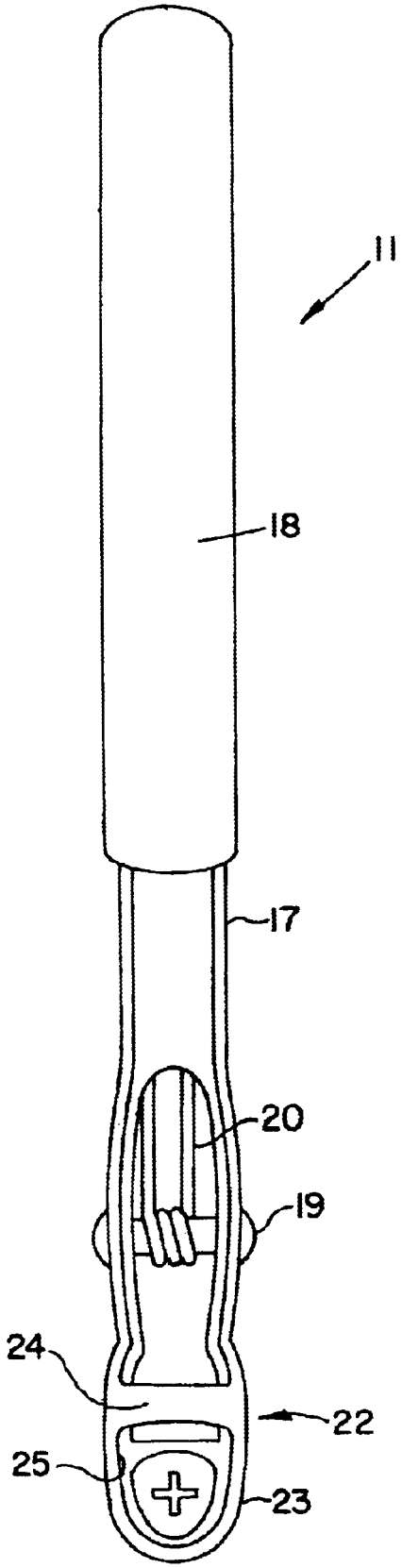
FIG. 1 is an elevational view of the vinyl siding locking tool of this invention.
Figure 3:
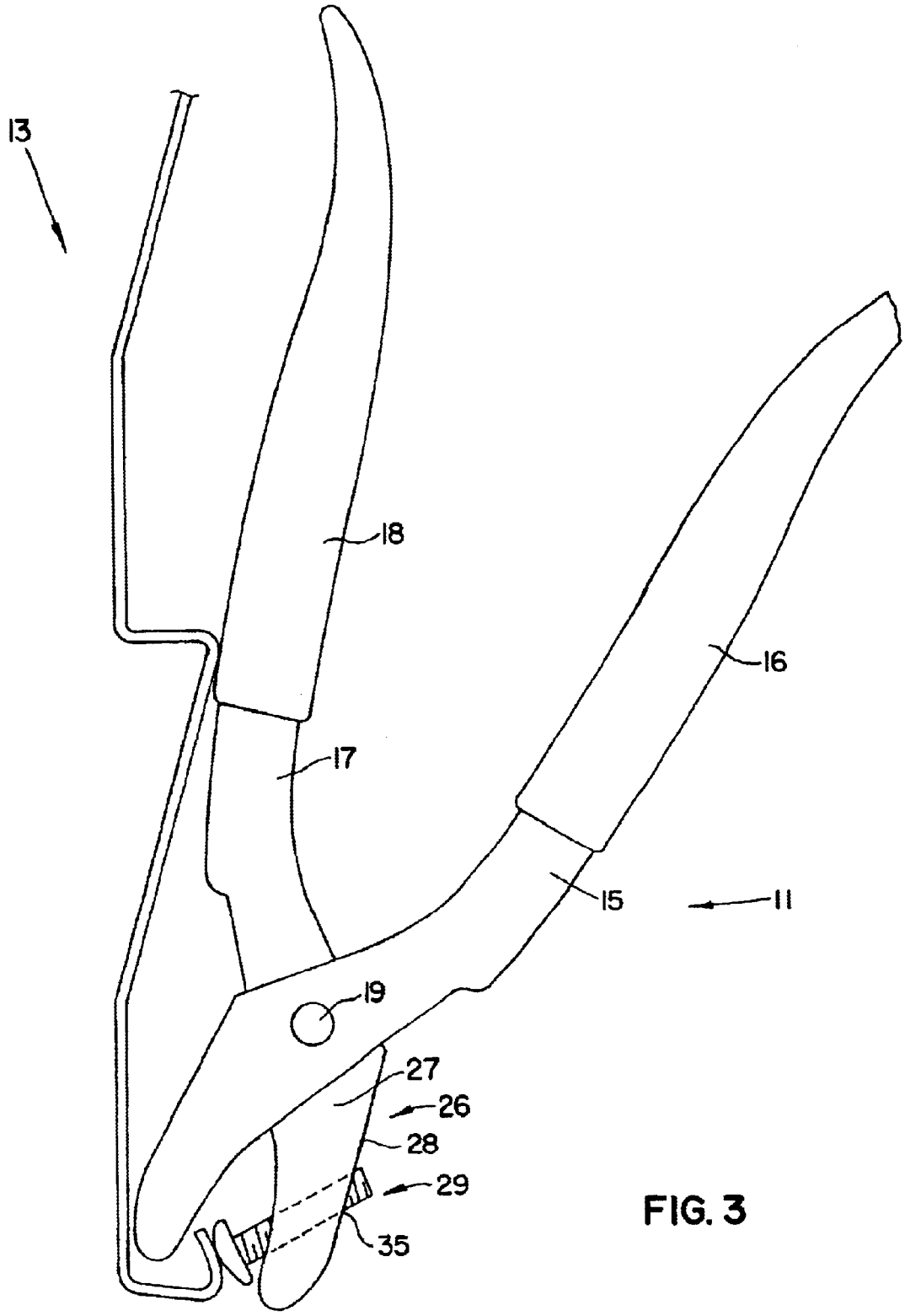
FIG. 3 is an elevational view showing application of the tool to a siding strip.

Referring now to the drawings, wherein like reference numerals designate identical or corresponding parts throughout the several views, FIG. 1 shows the vinyl siding locking tool of this invention generally at (11) and further in FIG. 3 employed to operate on a vinyl siding strip (13).

Referring again to FIG. 3, the tool (11) includes a first handle member (15) having a first hand grip (16) and a second handle member (17) having a second hand grip (18). The handle members (15, 18) are pivotally connected by a bolt (19). A bias spring (20) is mounted to bolt (19) and engages the handle members (15, 17).

A first jaw member (22) projects from first handle member (15) to the opposite side of the pivot bolt (19). Referring again to FIG. 1, the first jaw member (22) includes a U-shaped side wall (23). A transverse member (24) partially spans the side wall (23). The side wall (23) and transverse member (24) form an open channel (25).

Referring again to FIG. 3, a second jaw member (26) projects from second handle (17) to the opposite side of pivot bolt (19). Second jaw member includes a U-shaped side wall (27). A transverse wall (28) spans the side wall (27). A crimp bolt (29) projects through, and is supported by transverse wall (28).

Figure 2:
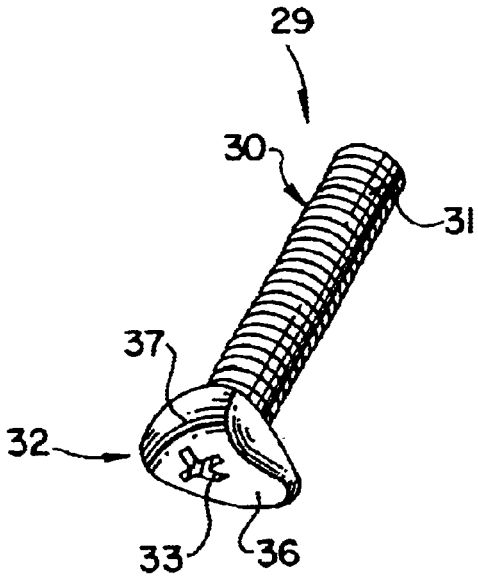
FIG. 2 is an enlarged, perspective view showing the crimp bolt portion of the vinyl siding locking tool.

Referring now to FIG. 2, the crimp bolt (29) includes a shaft (30) along the length thereof. A head (32) is fixed to one end of shaft (30) and has grooves (33) formed therein for engagement by a screw driver or the like. Referring also to FIG. 1, when the head (32) is viewed in end elevation, the periphery thereof is a rounded triangular shape, defining a tapered area (36) and an opposite wider area (37). As can be seen in FIG. 3, in side elevation, the slope of the tapered area (36) from the periphery to the grooves (33) is less than the slope of the wider area (37) from the periphery to the grooves (33).

The crimp bolt (29) is threaded through a bore (35) formed in transverse wall (28) such that the head (32) is positioned in the space between the first and second jaw members (22, 26). Rotation of the crimp bolt (29) is employed to adjust the operating position of the head (32) between the first and second jaw members (22, 26). The crimp bolt (29) is positioned such that the tapered area (36) is directed toward second jaw (26) and the wider area (37) is directed toward first jaw (22). Preferably the crimp bolt (29) is disposed at an angle to the long axis of second jaw member (26) on the order of 40° to 50°.

Figure 4:
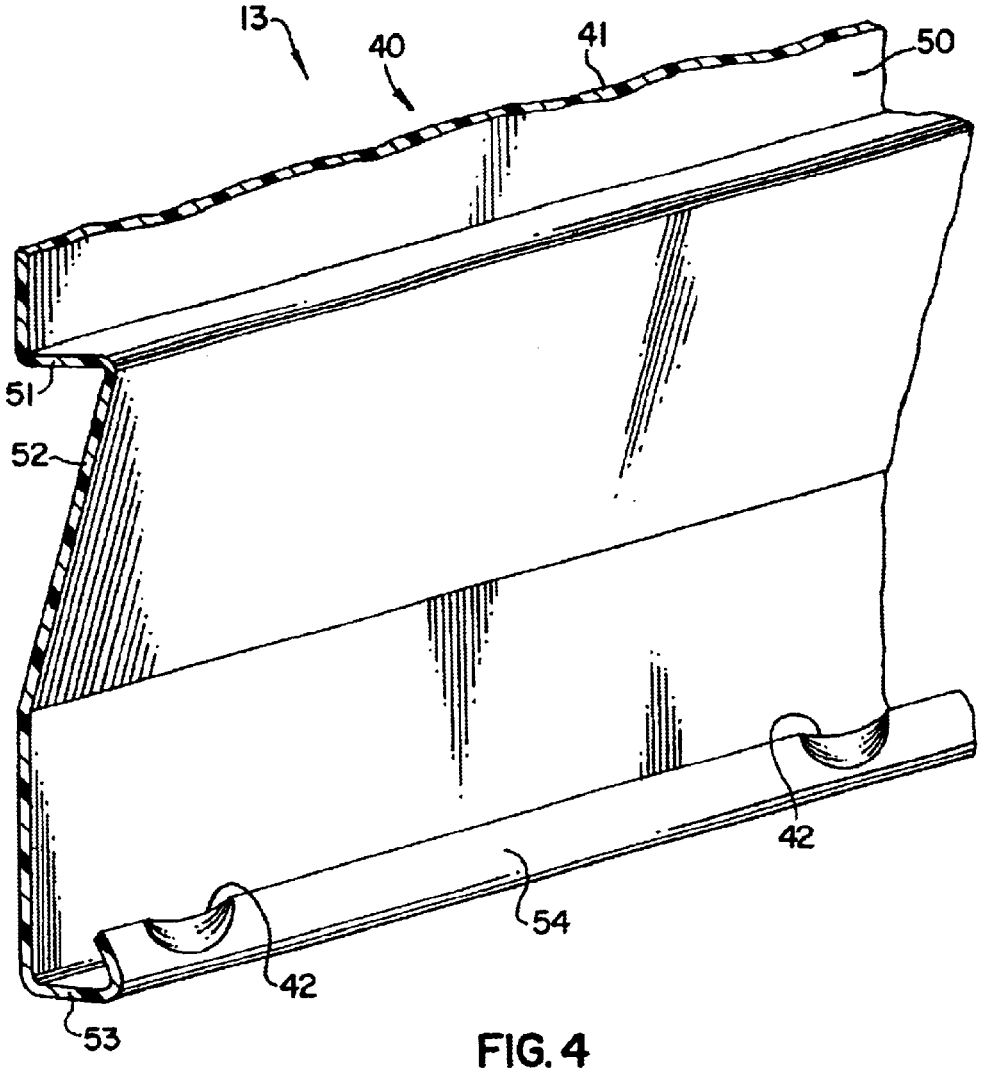
FIG. 4 is a fragmentary, perspective view showing the siding strip after engagement by the tool.
Figure 5:
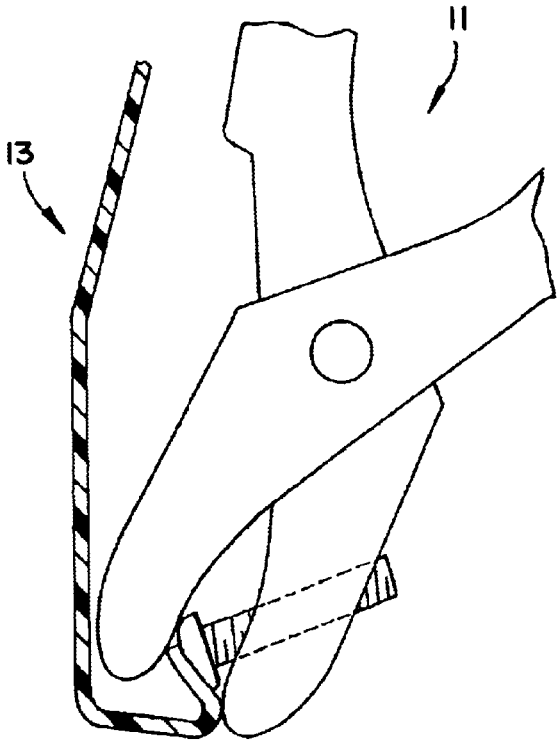
FIG. 5 is an enlarged, fragmentary, partly sectional view showing engagement of the siding strip by the tool.

Referring next to FIG. 4, a double declination vinyl siding strip (13) is shown having the upper portion cut off at (41) to form the top siding strip (40) which abuts against the J-trim (not shown) at the top of the wall of the house or other building being sided. Crimps (42) have been formed in panel lip (54) of siding strip (40) to facilitate a positive lock with the highest nailed siding strip (13). FIGS. 3 and 5 show application of the tool (11) to form the crimps (42). The crimps (42) preferably are formed toward the top edge of panel lip (54).

Figure 6:
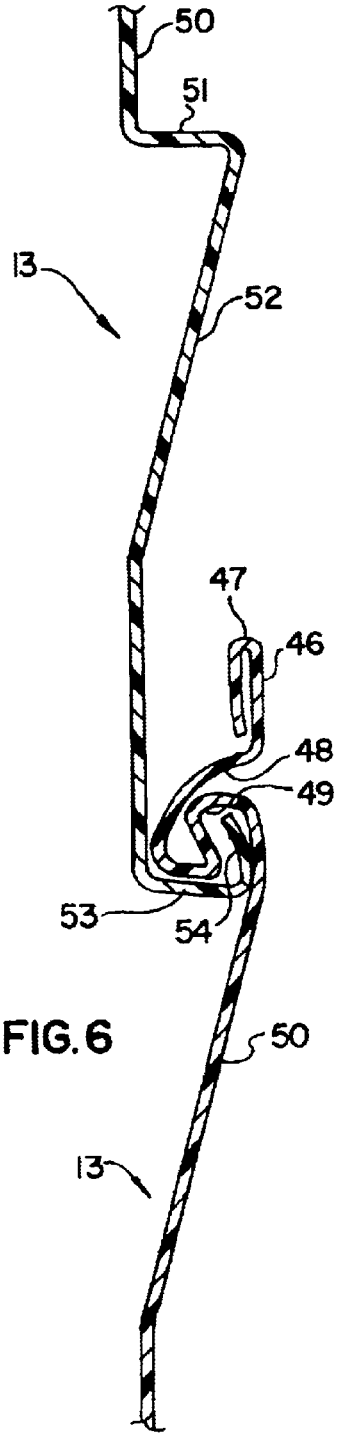
FIG. 6 is a vertical sectional view showing interlocking of two typical vinyl siding strips.

Referring to FIG. 6, two double declination vinyl siding strips (13) are shown connected in conventional fashion. Each strip (13) normally has a nailing flange (46) having an upper or top lip portion (47). Depending from the nailing flange (46) is a channel portion (48) which opens upwardly and to the rear of the strip (13). Immediately below is a companion channel (49) opening downwardly and to the front side of the strip (13). Upper panel declination (50) extends downwardly from channel (49) to an upper shoulder area (51) formed to create a lap appearance. Lower panel declination (52) extends downwardly from upper shoulder (51), terminating at a lower shoulder (53) extending toward the back side of strip (13). An upwardly extending panel lip (54) is formed along the inwardly disposed edge of lower shoulder (53). The panel lip (54) of an upper siding strip (13) fits into the channel (49) of a lower siding strip (13) in the conventional case.

Figure 7:
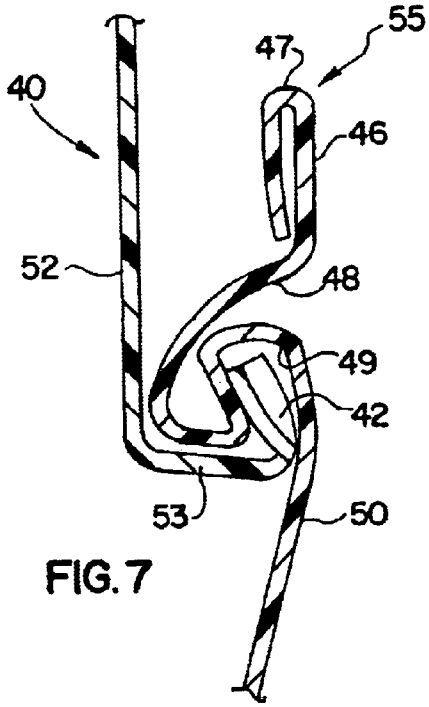
FIG. 7 is an enlarged fragmentary sectional view illustrating attachment of adjacent vinyl strips after operation of the tool of this invention on the same.

Referring to FIG. 7, the top siding strip (40) is shown attached to the highest nailed siding strip (55). The crimps (42) formed in panel lip (54) of top strip (40) span the channel (49) of the highest nailed strip (55). Positive engagement of the wall surfaces of channel (49) by the crimp (42) provides a positive lock between the top siding strip (40) and the top nailed siding strip (55). This obviates any need for the utility trim piece commonly employed in the art.

The industrial applicability of the vinyl siding locking tool (11) is believed to be apparent from the foregoing description. Although only exemplary embodiments of the invention have been described in detail above, those skilled in the art will readily appreciate the many modifications are possible without materially departing from the novel teachings and advantages of this invention. Accordingly, all such modifications are intended to be included within the scope of this invention as defined in the following claims.

In the claims, means-plus-function clauses are intended to cover both equivalent structures and structural equivalents of the structures described herein as performing the claimed function.

I claim:

1. A tool, for operation on a siding strip, comprising:

first lever, having a first jaw;

second lever, having a second jaw;

said first jaw having a crimp bolt, said crimp bolt has a head portion, said head portion having a first surface with a first curvature and a second surface with a second curvature, said first and second surfaces have a periphery which is generally triangular in shape;

said second jaw forming a channel;

said levers being pivotally coupled and operable to move said crimp bolt toward and away from said channel.

2. The tool of claim 1, wherein said periphery has the general shape of an isosceles triangle.

3. The tool of claim 2, wherein said second surface extends toward said periphery at the isosceles triangle short side portion thereof.

4. The tool of claim 2, wherein said first surface extends toward said periphery away from the isosceles triangle short side portion thereof.

* * * * *